US009618164B1

(12) United States Patent
Berry et al.

(10) Patent No.: US 9,618,164 B1
(45) Date of Patent: Apr. 11, 2017

(54) ADAPTER FOR RETROFITTING LED LAMPS, METHOD OF USE, AND LIGHTING FIXTURE WITH RETROFIT ADAPTER

(71) Applicant: Universal Lighting Technologies, Inc., Madison, AL (US)

(72) Inventors: Travis L. Berry, Madison, AL (US); Keith Davis, Madison, AL (US); Theodore E. Kluska, Madison, AL (US); Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 5 days.

(21) Appl. No.: 14/736,878

(22) Filed: Jun. 11, 2015

Related U.S. Application Data

(60) Provisional application No. 62/010,548, filed on Jun. 11, 2014.

(51) Int. Cl.

| | |
|---|---|
| ***F21V 21/00*** | (2006.01) |
| ***F21K 99/00*** | (2016.01) |
| ***F21V 23/06*** | (2006.01) |
| ***F21V 19/00*** | (2006.01) |
| ***F21V 17/14*** | (2006.01) |
| *F21Y 103/00* | (2016.01) |

(52) U.S. Cl.
CPC ..... *F21K 9/175* (2013.01); *F21V 17/14* (2013.01); *F21V 19/0085* (2013.01); *F21V 23/06* (2013.01); *F21Y 2103/003* (2013.01)

(58) Field of Classification Search
CPC ..... F21K 9/175; F21V 23/06; F21V 19/0085; F21V 17/14; F21V 19/008; F21Y 2103/003; F21Y 2103/10; F21Y 2103/00; G02F 1/133604; G02F 1/133608
See application file for complete search history.

(56) References Cited

U.S. PATENT DOCUMENTS

| | | | | |
|---|---|---|---|---|
| 3,245,026 A * | 4/1966 | Pistey | F21V 19/00 | 313/318.01 |
| 7,052,171 B1 * | 5/2006 | Lefebvre | F21K 9/175 | 362/217.12 |
| 2016/0084448 A1 * | 3/2016 | Deng | F21K 9/175 | 362/217.17 |

* cited by examiner

*Primary Examiner* — Y M Lee
(74) *Attorney, Agent, or Firm* — Patterson Intellectual Property Law, P.C.; Mark J. Patterson; Grant M. Ford

(57) ABSTRACT

An adapter is provided for retrofitting a lighting fixture with a light emitting diode (LED) lamp. The adapter includes a pin plate and a retaining ring. The pin plate includes at least one pin extending outward from a distal side of the pin plate. The retaining ring includes a base, at least one arm, and at least one projecting member, each having inward and outward surfaces. The at least one pin restricts movement of the adapter when the adapter is rotated to a restraining position. The at least one projecting member causes the inward surface of the at least one projecting member to face the inward surface of the base. The at least one projecting member restricts movement of the adapter in a direction corresponding to an axis of rotation of the adapter using the at least one projecting member.

30 Claims, 6 Drawing Sheets

ADAPTER FOR RETROFITTING LED LAMPS, METHOD OF USE, AND LIGHTING FIXTURE WITH RETROFIT ADAPTER

CROSS-REFERENCES TO RELATED APPLICATIONS

This application claims benefit of U.S. Provisional Patent Application No. 62/010,548, dated Jun. 11, 2014, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to adapters for retrofitting lighting fixtures with light emitting diode (LED) lamps, a method of using the adapters, and a lighting fixture incorporating the adapters.

Many conventional lighting systems typically include fluorescent, neon, or incandescent bulbs connected to an electrical power supply or driver circuit. Such conventional lighting systems are commonly found in overhead or ground-level lighting applications, in buildings or vehicles, and in display applications such as commercial signs and billboards. However, conventional lighting systems present numerous problems. For example, conventional light bulbs inefficiently consume power and must be frequently replaced.

LED lighting is growing in popularity due to its decreasing costs and long life compared to incandescent and fluorescent lighting. Retrofitting LED lamps to operate with traditional incandescent and fluorescent lighting fixtures is one way to obtain benefits of LED lighting while using existing incandescent and fluorescent lighting infrastructure. However, existing lighting fixtures may utilize different connectors and power configurations than required for LED lamps.

Fluorescent lamps come in numerous tube sizes and may have numerous connector configurations for connecting to a socket. For example, fluorescent lamp tube varieties include T2, T4, T5, T8, T9, T10, T12, T17, and PG17 tubes, each having different tube diameters. Variety also exists in fluorescent tube bases (e.g., connectors). These bases may include, for example, single pin connectors, bi-pin connectors, four pin connectors, and the like.

Typical fluorescent lighting fixtures include a ballast for starting and powering a fluorescent lamp. Three main ignition types exist for such ballasts: rapid start, instant start, and programmed start. Rapid start ballasts operate by simultaneously applying voltage and providing cathode heating. Instant start ballasts provide high voltage across a lamp while starting, but do not heat the cathode like rapid start ballasts. Programmed start ballasts provide a specific starting sequence, for example, by first providing cathode heat then applying a voltage to a lamp. Performance benefits of each ballast type vary based upon the number of time a lamp starts and a total active duration. The variety of ballast start mechanisms are intended to extend the life of fluorescent lamps receiving power from the ballast.

Unlike fluorescent lamps, LED lamps do not require the use of a traditional ballast to operate. Instead, LED lamps typically operate in accordance with power provided from an LED driver. Accordingly, when retrofitting a fluorescent lamp with an LED lamp, it is not necessary for an LED lamp to operate with an existing ballast in a lighting fixture. However, removing a ballast from an existing lighting fixture and replacing it with an LED driver may be time-consuming and costly. As such, a need exists for retrofitting a traditional fluorescent light fixture with an LED lamp which does not require modification to the existing fluorescent lamp structure.

BRIEF SUMMARY OF THE INVENTION

One embodiment of the present invention provides an adapter for retrofitting a lighting fixture with a light emitting diode (LED) lamp. The lighting fixture has both distal and proximal sides. The adapter includes a pin plate and a retaining ring. The pin plate has both distal and proximal sides, and includes at least one pin extending outward from the distal side of the pin plate. The retaining ring includes a base, at least one arm, and at least one projecting member. The base, arm, and projecting member have inward and outward surfaces. The pin is configured to restrict movement of the adapter when the adapter is rotated to a restraining position. The arm extends outwardly from the inward surface of the base. The projecting member extends outwardly from the inner surface of the arm. The projecting member is configured to cause the inward surface of the projecting member to face the inward surface of the base. The projecting member is configured to restrict movement of the adapter in a direction corresponding to an axis of rotation of the adapter.

Another embodiment of the present invention provides a method for retrofitting a lighting fixture with an LED lamp using an adapter. The adapter includes a pin plate with at least one pin. The pin plate is connected to a retaining ring having a base, at least one arm, and at least one projecting member. The lighting fixture includes a socket having distal and proximal sides and an opening. The distal side of the socket includes a pin contact surface. The pin plate slides into the opening in the socket when the adapter is positioned at the opening of the socket and moved in a sliding direction. Contact between the pin plate of the adapter and the pin contact surface of the adapter restricts movement of the adapter when the adapter is rotated to a restraining position. Movement along an axis of rotation of the adapter is restricted when the adapter is connected to the lighting fixture.

A further embodiment of the present invention provides a lighting fixture for retrofitting a LED lamp. The lighting fixture includes a fixture body at opposite ends of the lighting fixture and a plurality of sockets attached at the opposite ends of the lighting fixture. The sockets are configured so as to receive a lamp and to form electrical and mechanical connections with the lamp. The lamp is an LED lamp and the lighting fixture includes at least one adapter. The adapter includes a pin plate and a retaining ring. The pin plate has distal and proximal sides, and includes at least one pin extending outwardly from the distal side of the pin plate. The retaining ring includes a base, at least one arm, and at least one projecting member. The base, arm, and projecting member include inward and outward surfaces. The pin is configured to be rotated to a restraining position. The arm extends outwardly from the inward surface of the base. The projecting member extends from the inner surface of the arm and is configured to cause the inward surface of the projecting member to face the inward surface of the base. The projecting member restricts movement of the adapter in a direction corresponding to an axis of rotation of the adapter.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
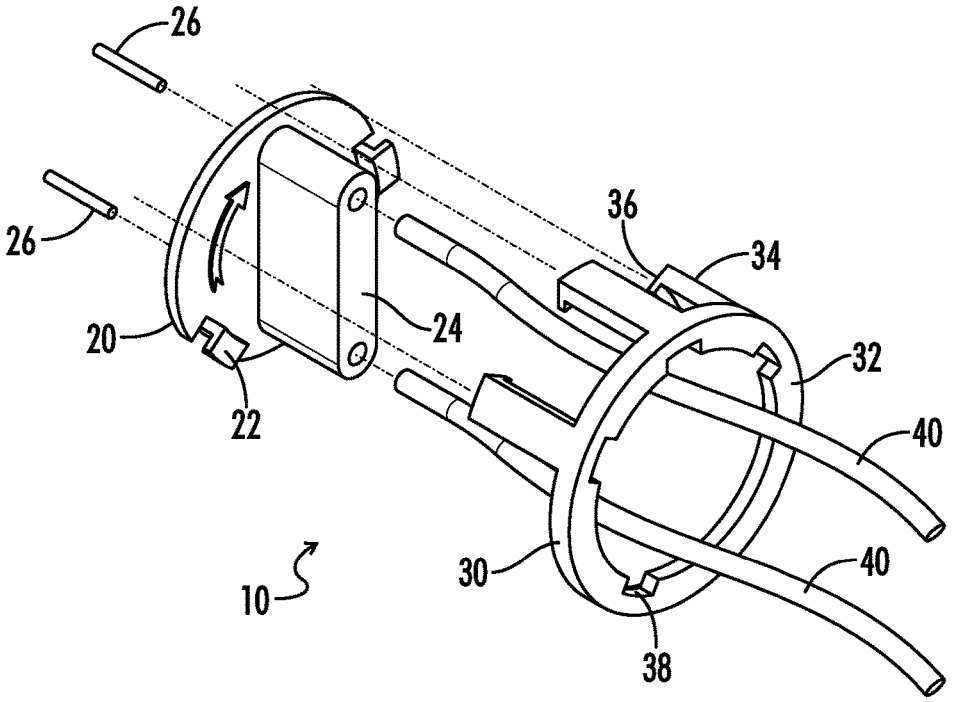
FIG. 1 is an exploded view of a retrofit adapter according to an exemplary embodiment.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-5, an adapter, associated methods, and a lighting fixture according to the present invention are now illustrated in greater detail. Where the various figures may describe embodiments sharing various common elements and features with other embodiments, similar elements and features are given the same reference numerals and redundant description thereof may be omitted below.

Various embodiments of an adapter according to the present invention may be designed in order to electrically and mechanically connect an LED lamp to a conventional lighting fixture. Embodiments of an adapter may further be designed such that the adapter is configured to operate with an internal structure of a conventional lighting fixture. The adapter, associated structure and methods as presented in this disclosure further address connecting an LED lamp to a conventional lighting fixture socket using the adapter.

In one exemplary embodiment illustrated, for example, at FIG. 1 and FIGS. 3-5A-F, an adapter 10 may be used to electrically and mechanically connect to a socket 200 of a lighting fixture 300. In one exemplary embodiment, an adapter 10 may be used for connection between an LED lamp 100 and a socket 200 of a lighting fixture 300. In an alternate embodiment, the LED lamp 100 may be connected to two adapters 10, each located at opposing ends of the lighting fixture 300, to the two adapters 10 being connected at opposing sockets 200 of a conventional fluorescent lighting fixture.

In an alternate embodiment according to the present disclosure, the adapter 10 may be considered a part of a lighting fixture 300 when attached to a socket 200. In another alternate embodiment, adapter 10 may be separate from the LED lamp 100 and lighting fixture 300, and may be configured to connect between the socket 200 and LED lamp 100. For example, the adapter 10 may be configured to form electrical and mechanical connections with the socket 200 at a first side, and connect to a power supply 110 at a second side. The power supply 110 may then optionally connect to an LED module 130 for electrically and mechanically coupling to the LED lamp 100. Thus, it is apparent that the number and types of adapters 10 may be modified used without departing from the spirit and the scope of the present invention. Alternatively, at least one adapter 10 may, in one embodiment, be implemented as part of an LED lamp 100.

Figure 2:
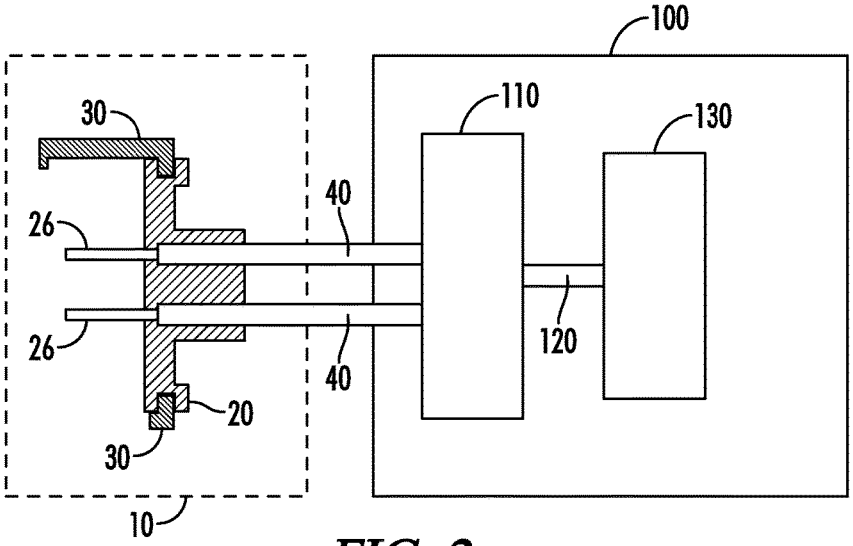
FIG. 2 is a block diagram representing an implementation of a retrofit adapter according to an exemplary embodiment.

As shown in FIGS. 1-2, in one exemplary embodiment, an adapter 10 may include pin plate 20, retaining ring 30, and conductor 40. Pin plate 20 may include distal and proximal sides. One or more pins 26 may be located at the distal and/or the proximal sides of the pin plate 20 for connection to a power source. In one exemplary embodiment, the one or more pins 26 may have conductive metal segments which form an electrical connection between the socket 200 of the lighting fixture 300 and the adapter 10. Alternatively, the one or more pins 26 may be any conductive material capable of conveying power between a power source and the adapter 10.

A pin configuration of the one or more pins 26 may be determined at a time of adapter manufacturing in one embodiment. For example, the pin configuration may be designated as a bi-pin configuration for a T8 lamp. Alternatively, the adapter 10 may be manufactured with a plurality of the one or more pins 26, which may be manipulated, for example by a user, to arrive at a desired pin configuration. This may be accomplished, for example, by including two pair of the one or more pins 26, where a user may determine a designated pin configuration and modify or remove the non-designated pair of the one or more pins 26.

Pin plate 20 of adapter 10 further includes one or more hooks 22 extending outwardly from the proximal side of the pin plate 20. The one or more hooks 22 may be used to connect the pin plate 20 with the retaining ring 30. Pin plate 20 further includes a housing 24. The housing 24 is configured to electrically connect the one or more pins 26 with the conductor 40 of the adapter 10. The housing 24 may further permit rotation of the pin plate 20 when used as part of an adapter 10 connected to a socket 200.

The retaining ring 30 of the adapter 10 includes front and rear surfaces and may include a base 32, at least one arm 34, and/or at least one projecting member 36, each having front and rear surfaces. The base 32 of retaining ring 30 may, in one embodiment, include one or more openings 38 configured to receive the one or more hooks 22 of the pin plate 20 to attach the pin plate 20 to the retaining ring 30 (as illustrated, for example, at FIG. 2). Although illustrated as being located at an outer radial surface of the retaining ring 30, the one or more openings 38 may be positioned at any location of the retaining ring 30. Likewise, the one or more hooks 22 of the pin plate 20 may positioned at any location of the pin plate 20.

Once connected to retaining ring 30, the pin plate 20 may, in one embodiment, be capable of rotation independent of the retaining ring 30. For example, when an adapter 10 is connected to a socket 200 of lighting fixture 300, the pin plate 20 may be rotated towards a restraining position independent of retaining ring 30 (e.g., by use of housing 24), whereas retaining ring 30 may be configured to remain stationary when connected to the socket 200. In such a configuration, movement of the adapter 10 may be restricted in vertical, horizontal, and longitudinal (e.g., according to a rotation axis of the adapter 10) directions when connected to the socket 200.

The at least one arm 34 of retaining ring 30 extends outwardly from the base 32 in a direction perpendicular to an inward surface of the base 32. Alternatively, the at least one arm 34 may extend outwardly from the inward surface of the base 32 at any angle capable of connecting the retaining ring 30 to the socket 200 of the lighting fixture 300. The at least one arm 34 extends outward from the base 30 and may, in one embodiment, comprise a length greater than or equal to the one or more pins 26. The length of the at least one arm 34 may vary, and in one embodiment, may be greater than or equal to a width of a socket 200 to which the adapter is configured to connect.

The at least one projecting member 36 of the retaining ring 30 extends outwardly from the at least one arm 34 in a direction perpendicular to an inward surface of the at least one arm. Alternatively, the at least one projecting member 36 may extend outwardly from the inward surface of the at least one arm 34 at any angle capable of placing the at least one projecting member 36 in contact with the socket 200 of the lighting fixture 300. In one embodiment, an inward surface of the at least one projecting member 36 may be configured to be placed in contact with a distal side of the socket 200, and an inward surface of the base 32 may be configured to be placed in contact with a proximal side of the socket 200.

Base 32 of retaining ring 30 may form a ring shape having an inner and an outer diameter forming a cavity therein. A shape, diameter, or thickness of the retaining ring 30 may be predetermined, or may be modified in accordance with a configuration of a lighting fixture, lamp, pin plate, etc. In one embodiment, an outer diameter of the retaining ring 30 may be selected based upon a lamp diameter (e.g., related to a corresponding diameter of a T8 or T12 lamp) for a lamp intended for use with the lighting fixture. Alternatively or in conjunction with a modified outer diameter of the retaining ring 30, an inner diameter or shape of the retaining ring 30 may be modified or selected based upon a preferred aperture or cavity size for the retaining ring 30.

Although retaining ring 30 has been described as possessing a ring-like shape, the retaining ring 30 may form any shape capable of attachment to pin plate 20 and connection with socket 200 of lighting fixture 300, without departing from the spirit or the scope of the present invention.

The conductor 40 of adapter 10 forms an electrical connection with the one or more pins 26 of pin plate 20. Conductor 40 is configured to pass through an aperture or cavity in the body 32 of the retaining ring 30 and to electrically connect to the one or more pins 26 of the pin block 20. Conductor 40 may include one or more conductive members. In one embodiment, the conductive members of conductor 40 may be one or more metal wires. However, conductor 40 may be formed of one or more of any conductive material capable of conveying electricity received from the one or more pins 26 of the pin block 20.

Figure 3:
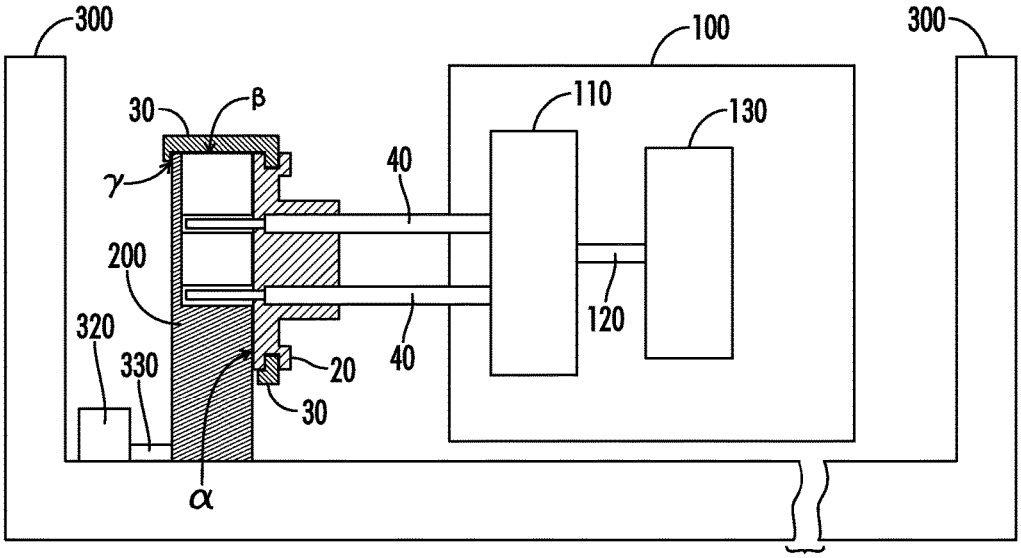
FIG. 3 is a block diagram representing a retrofit adapter coupled to a lighting fixture socket according to an exemplary embodiment.

As described with reference to an exemplary embodiment illustrated by FIG. 2, adapter 10 may be connected to a power supply 110 associated with LED lamp 100 via conductor 40. Conductor 40 may convey electricity received at the one or more pins 26 of the pin block 20 to a power supply 110. In one embodiment, the power conveyed by conductor 40 may be received from pin plate 20 after receipt from socket 200. As illustrated at FIG. 3, a ballast 320 of a lighting fixture 300 may transmit power to the socket 200 along ballast path 330 (as illustrated, for example, at FIG. 3). Power supply 110 is connected to LED module 130 of LED lamp 100 via electrical path 120. Path 120 may include one or more conductive materials capable of conveying electricity between the power supply 110 and LED module 130. The LED module 130 may include one or more LED lights configured to operate according to input received from the power supply 110 along path 120.

The power supply 110 may, in one embodiment, be an LED driver configured to receive input power from the ballast 320, which was received via the socket 200 of the lighting fixture 300, operate upon the received input power, and provide an LED control output to the LED module 130 along path 120 according to the received input power and an LED light property. The LED light property may include, for example, a predetermined characteristic, a lamp characteristic, a number of LED lights associated with the LED lamp 100, a series or parallel configuration LED lights of the LED lamp 100, etc. In one embodiment, the power supply 110 may output a constant voltage and/or current along path 120 to the LED module 130.

FIG. 3 illustrates an exemplary embodiment in which an adapter 10 is connected to a socket 200 of a lighting fixture 300. In this embodiment, the one or more pins 26 are in contact with socket 200, an inner surface of pin plate 20 is in contact with a proximal surface of socket 200 at contact surface a, an inner surface of arm 34 of retaining ring 30 is in contact with a top surface of socket 200 at contact surface 13, and an inner surface of projecting member 36 is in contact with a distal surface of socket 200 at contact surface y.

Although contact between the arm 34 and projecting member 36 of retaining ring are illustrated as being in contact with socket 200, any or all of the body 32, the at least one arm 34, and/or the at least one projecting member 36 may be in contact with socket 200, so long as the one or more pins 26 of pin plate 20 form an electrical connection with the socket 200, and projecting member 36 is configured to contact the distal surface of socket 200. For example, in one embodiment, only the inner surface of projecting member 36 may be in contact with a distal surface of socket 200.

Figure 4:
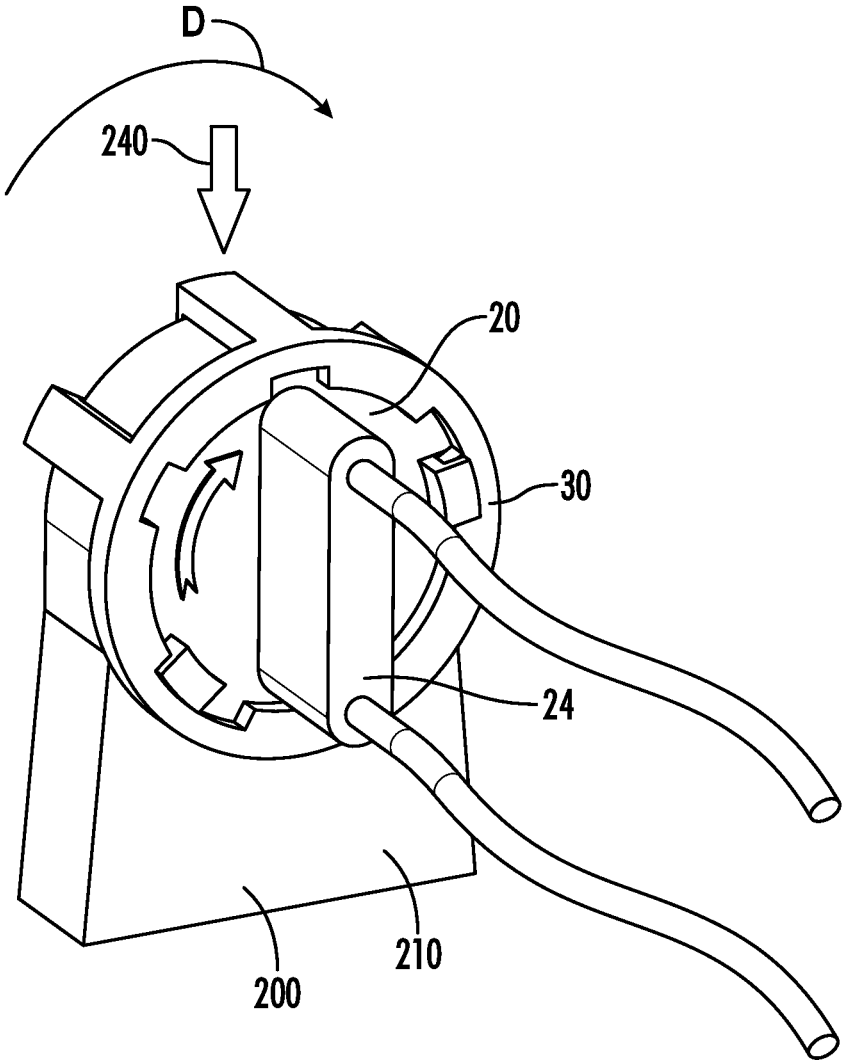
FIG. 4 is a front perspective view of a retrofit adapter coupled to a lighting fixture socket according to an exemplary embodiment.

FIG. 4 provides a top perspective view of an adapter 10 connected to a socket 200 in accordance with an embodiment of the present disclosure. As illustrated, adapter 10 may attach to a socket 200 at an opening 220, located at an upper portion of body 210 of socket 200. The opening 220 permits adapter 10 to be positioned at an interior portion 230 (illustrated, for example, at FIG. 5A) of the socket 200 in a fitting direction 240. When positioned at the interior portion 230 of socket 200, at least a portion of the adapter 10 may rotate in a primary rotation direction D (e.g., pin plate 20). By rotating at least a portion of the adapter 10 at the interior portion 230 of socket 200, the adapter 10 and socket 200 may be electrically and mechanically connected to one another.

According to one embodiment of the present disclosure, the at least one projecting member 36 of retaining ring 30 is configured to slide over the distal surface of socket 200 when the adapter 10 is moved in the sliding direction 240. When the retaining ring is rotated in the primary rotation direction D, contact between the inner surface of the at least one projecting member 36 and the distal surface of the socket 200 are configured to restrict movement in a longitudinal direction of an LED lamp 100 to which the adapter 10 is configured to be connected (e.g., a rotation axis of the adapter).

Figure 5A:
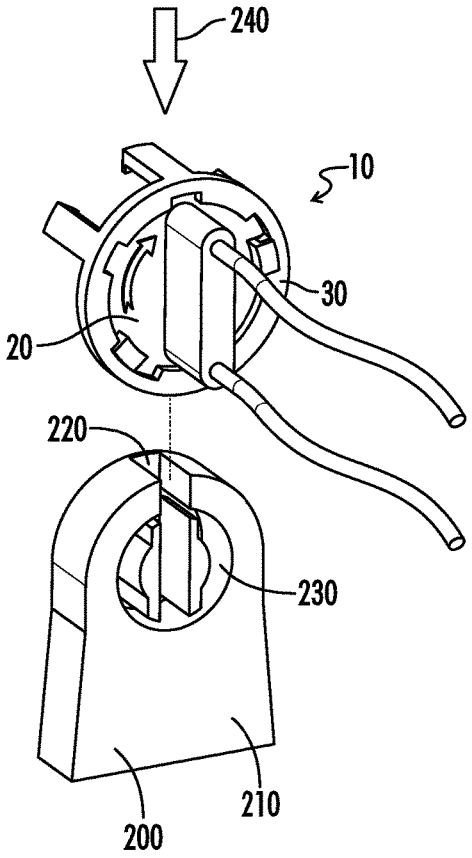
FIGS. 5A-F illustrate a sequence of steps for coupling a retrofit adapter and a lighting fixture socket according to an exemplary embodiment.

FIGS. 5A-F illustrate a sequence of connecting an adapter 10 and socket 200 and forming electrical and mechanical connections therebetween. FIG. 5A illustrates a front perspective view of an adapter 10 which is not connected to socket 200. To place the adapter 10 in contact with socket 200, the socket 10 is positioned above opening 220 of socket 200 and moved in the sliding direction 240.

Figure 5B:
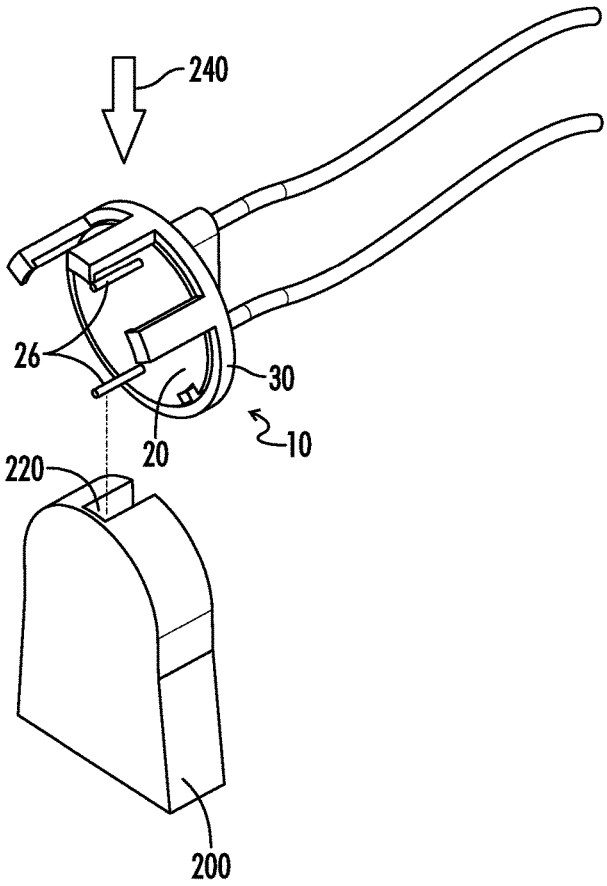

FIG. 5B provides a rear perspective view of the embodiment illustrated by FIG. 5A. As shown by FIG. 5B, the adapter 10 may be configured to slide over and around at least a portion of the socket 200, causing at least a portion of pin plate 20 and/or retaining ring 30 to be placed in contact with socket 200. In one embodiment, pins 26 of the pin plate 20 of adapter 10 may be configured to be received by opening 220 of socket 200.

Figure 5C:
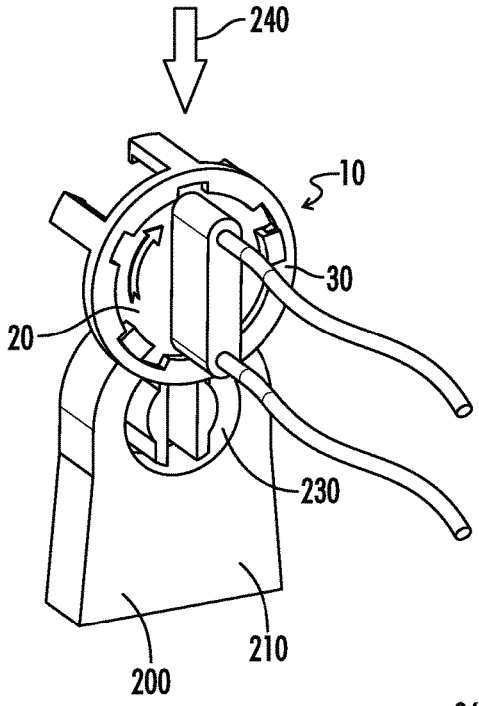

FIG. 5C illustrates a front perspective view of an exemplary embodiment at a point when at least a portion of the adapter 10 reaches the interior portion 230 of the socket 200 in the sliding direction 240. At this point, the adapter 10 may be rotated in the primary rotation direction D to electrically and mechanically connect the adapter 10 and socket 200 as described above.

Figure 5D:
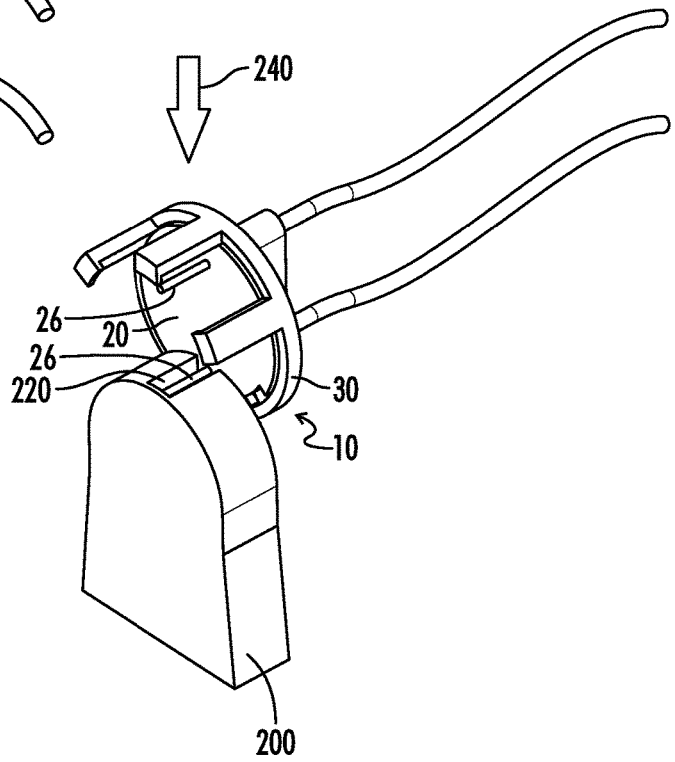

FIG. 5D provides a rear perspective view of the embodiment illustrated by FIG. 5C. As shown by FIG. 5D, at least a portion of adapter 10 may be configured to be received by the opening 220 of socket 200. As illustrated by FIG. 5D, at least one pin 26 of adapter 10 may be received in the sliding direction 240 at the opening 220 of socket 200.

Figure 5E:
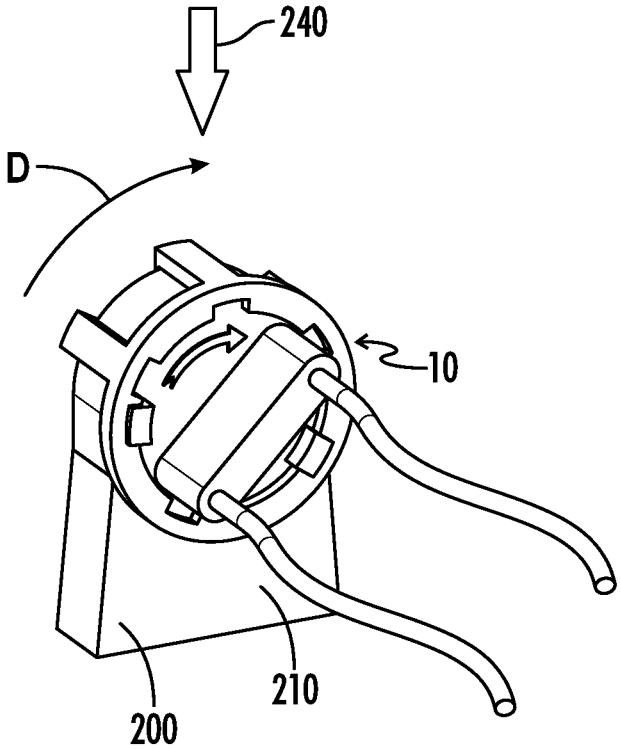
Figure 5F:
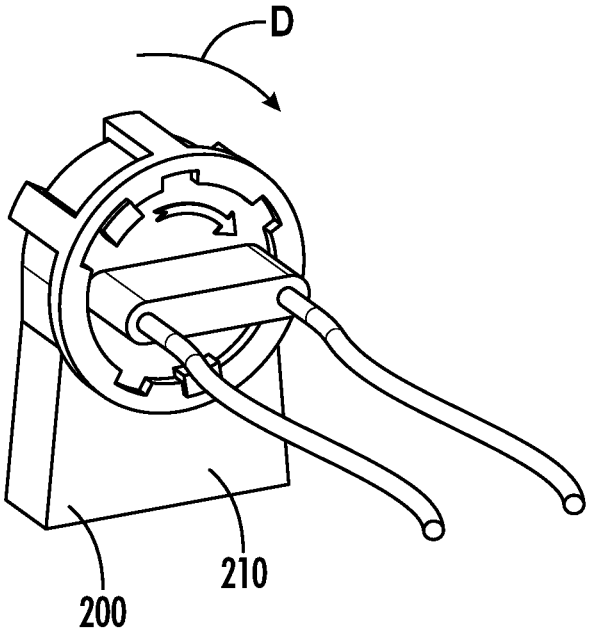

FIG. 5E illustrates an exemplary implementation showing rotation of the pin plate 20 in the primary rotation direction D after the adapter 10 has reached a locking position associated with socket 200. FIG. 5F illustrates further rotation of pin plate 20 illustrated by FIG. 5E to reach a restraining position. Although not illustrated in FIGS. E-F, in one embodiment, the retaining ring 30 may rotate in the primary rotation direction D along with pin plate 20, either at the same rate or a relative rate to that of the pin plate 20. Alternatively, the retaining ring 30 may remain stationary in one embodiment when the pin plate 20 is rotated in the primary rotation direction D.

According to one embodiment, an adapter 10 that is in an electrically and mechanically connected state with the socket 200 may be disconnected and removed from the socket 200 by rotating the adapter 10 in an opposite direction from the primary rotation direction D. The adapter 10 may then be moved in a direction opposite to the sliding direction 240 to exit the opening 220 of the socket 200.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An adapter for retrofitting a lighting fixture that includes a socket having distal and proximal sides with a light emitting diode (LED) lamp, the adapter comprising:

a pin plate having distal and proximal sides, the pin plate comprising at least one pin extending outwardly from the distal side of the pin plate; and a retaining ring comprising a base, at least one arm, and at least one projecting member, each of the base, the at least one arm, and the at least one projecting member having an inward and an outward surface, wherein the at least one pin is configured to restrict movement of the adapter when the adapter is rotated to a restraining position, the at least one arm extends outwardly from the inward surface of the base, and the at least one projecting member extends from the inward surface of the at least one arm and is configured to cause the inward surface of the at least one projecting member to face the inward surface of the base, further wherein the at least one projecting member is configured to restrict movement of the adapter in a direction corresponding to an axis of rotation of the adapter.

2. The adapter of claim 1, wherein the inward surface of the at least one projecting member is configured to be placed in contact with the distal side of the socket of the lighting fixture, and the inward surface of the base is configured to be placed in contact with the proximal side of the socket.

3. The adapter of claim 1, wherein a shape of the pin plate and a diameter of the retaining ring are configurable based upon a predetermined configuration of the lighting fixture.

4. The adapter of claim 3, wherein the predetermined configuration of the lighting fixture is a pin configuration of a T8 lamp.

5. The adapter of claim 3, wherein the predetermined configuration of the lighting fixture is a pin configuration of a T12 lamp.

6. The adapter of claim 1, wherein:

the at least one projecting member comprises a plurality of projecting members;

the plurality of projecting members are configured to position the pin plate relative to the socket of the lighting fixture for rotation within the socket; and the pin plate is configured to rotate within the socket to reach the restraining position.

7. The adapter of claim 1, wherein the socket is configured to connect to a fluorescent lamp.

8. The adapter of claim 1, wherein the adapter further comprises at least one conductor configured to be electrically connected to the pin plate, wherein the retaining ring forms a ring shape having a cavity therein, and wherein the at least one conductor is configured to pass through the cavity of the retaining ring.

9. The adapter of claim 8, wherein the at least one conductor is configured to receive power from a ballast of the lighting fixture and to convey power to a power supply of the lighting fixture in order to drive an LED module associated with the LED lamp.

10. The adapter of claim 1, wherein:

the base comprises at least one opening; and the pin plate comprises at least one hook, wherein the at least one opening and the at least one hook are configured to attach the base to the pin plate.

11. The adapter of claim 1, wherein the pin plate is configured to rotate to the restraining position while the retaining ring does not rotate when placed in contact with the lighting fixture.

12. A method of retrofitting a lighting fixture with a light emitting diode (LED) lamp using an adapter, the adapter comprising a pin plate having at least one pin, the pin plate being connected to a retaining ring having a base, at least one arm, and at least one projecting member, the lighting fixture comprises a socket having distal and proximal sides and an opening, and the distal side of the socket comprising a pin contact surface, the method comprising:

positioning the adapter at the opening in the socket, wherein the at least one pin of the pin plate slides into the opening in the socket, and the at least one projecting member of the adapter covers the distal side of the socket;

rotating the adapter such that an electrical connection is formed between the pin plate of the adapter and the pin contact surface of the socket, wherein contact between the pin plate of the adapter and the pin contact surface of the socket restricts movement of the adapter when the adapter is rotated to a restraining position, and wherein movement along an axis of rotation of the adapter is restricted when the adapter is connected to the lighting fixture.

13. The method of claim 12, wherein the at least one projecting member comprises a plurality of projecting members and the method further comprises:

positioning the pin plate relative to the socket of the lighting fixture for rotating within the socket by the plurality of projecting members; and rotating the pin plate within the socket to reach the restraining position.

14. The method of claim 12, further comprising selecting a shape of the pin plate and a diameter of the retaining ring based upon a predetermined configuration of the lighting fixture.

15. The method of claim 14, wherein the predetermined configuration of the lighting fixture is a T8 lamp pin configuration.

16. The method of claim 14, wherein the predetermined configuration of the lighting fixture is a T12 lamp pin configuration.

17. The method of claim 12, wherein the adapter further comprises at least one conductor and the lighting fixture comprises a ballast, the method further comprising:

receiving power at the at least one conductor from the ballast of the lighting fixture, conveying power to a power supply of the lighting fixture, and driving an LED module associated with the LED lamp with the conveyed power.

18. The method of claim 12, wherein the base comprises at least one opening and the pin plate comprises at least one hook, the method further comprising:

attaching the retaining ring to the pin plate using the at least one opening and the at least one hook.

19. The method of claim 12, further comprising rotating the pin plate toward the restraining position without causing the retaining ring to rotate, when the adapter is placed in contact with the socket.

20. A lighting fixture for retrofitting a light emitting diode (LED) lamp, the lighting fixture comprising:

a fixture body having opposing ends;

a plurality of sockets having distal and proximal sides, the plurality of sockets being attached at the opposing ends of the fixture body, the plurality of sockets being configured to receive an LED lamp and to form electrical and mechanical connections with the LED lamp;

at least one adapter, the at least one adapter comprising a pin plate having distal and proximal sides, the pin plate comprising at least one pin extending outwardly from the distal side of the pin plate; and a retaining ring comprising a base, at least one arm, and at least one projecting member, each of the base, the at least one arm, and the at least one projecting member having an inward and an outward surface, wherein the at least one pin is configured to restrict movement of the at least one adapter when the at least one adapter is rotated to a restraining position, the at least one arm extends outwardly from the inward surface of the base, and the at least one projecting member extends from the inward surface of the at least one arm and is configured to cause the inward surface of the at least one projecting member to face the inward surface of the base, wherein the at least one projecting member is configured to restrict movement of the at least one adapter in a direction corresponding to an axis of rotation of the at least one adapter.

21. The lighting fixture of claim 20, wherein the inward surface of the at least one projecting member is configured to be placed in contact with the distal side of the socket of the plurality of sockets, and the inward surface of the base is configured to be placed in contact with the proximal side of the socket of the plurality of sockets.

22. The lighting fixture of claim 20, wherein a shape of the pin plate and a diameter of the retaining ring are configurable based upon a predetermined configuration corresponding to the plurality of sockets.

23. The lighting fixture of claim 22, wherein the predetermined configuration is a pin configuration of a T8 lamp.

24. The lighting fixture of claim 22, wherein the predetermined configuration is a pin configuration of a T12 lamp.

25. The lighting fixture of claim 20, wherein:

the at least one projecting member comprises a plurality of projecting members;

the plurality of projecting members are configured to position the pin plate relative to the socket of the plurality of sockets of the lighting fixture for rotating within the socket; and the pin plate is configured to rotate within the socket of the plurality of sockets to reach the restraining position.

26. The lighting fixture of claim 20, wherein the plurality of sockets are configured to receive fluorescent lamps.

27. The lighting fixture of claim 20, wherein the at least one adapter further comprises at least one conductor configured to be electrically connected to the pin plate, wherein the retaining ring forms a ring shape having a cavity therein, and wherein the at least one conductor is configured to pass through the cavity of the retaining ring.

28. The lighting fixture of claim 27, wherein the at least one conductor is configured to receive power from a ballast of the lighting fixture and to convey power to a power supply of the lighting fixture in order to drive an LED module associated with the LED lamp.

29. The lighting fixture of claim 20, wherein:

the base comprises at least one opening; and the pin plate comprises at least one hook, wherein the at least one opening and the at least one hook are configured to attach the base to the pin plate.

30. The lighting fixture of claim 20, wherein the pin plate is configured to rotate to the restraining position while the retaining ring does not rotate when placed in contact with the lighting fixture.

* * * * *